US012510097B1

(12) United States Patent
Trimble et al.

(10) Patent No.: US 12,510,097 B1
(45) Date of Patent: Dec. 30, 2025

(54) AXIAL FAN AND HOUSING ASSEMBLY AND METHODS OF USE THEREOF

(71) Applicant: Regal Beloit America, Inc., Milwaukee, WI (US)

(72) Inventors: Steven A. Trimble, Washburn, MO (US); Jacob Hansel, New Haven, IN (US); Chirag Patel, Rogers, AR (US); Pritesh Mandal, Fort Wayne, IN (US)

(73) Assignee: REGAL BELOIT AMERICA, INC., Milwaukee, WI (US)

( * ) Notice: Subject to any disclaimer, the term of this patent is extended or adjusted under 35 U.S.C. 154(b) by 0 days.

(21) Appl. No.: 18/805,008

(22) Filed: Aug. 14, 2024

(51) Int. Cl.

| | |
|---|---|
| ***F04D 29/52*** | (2006.01) |
| ***F04D 19/00*** | (2006.01) |
| ***F04D 29/32*** | (2006.01) |
| ***F04D 29/54*** | (2006.01) |

(52) U.S. Cl.
CPC ..... *F04D 29/522* (2013.01); *F04D 19/002* (2013.01); *F04D 29/325* (2013.01); *F04D 29/526* (2013.01); *F04D 29/547* (2013.01)

(58) Field of Classification Search
CPC .... F04D 19/002; F04D 29/325; F04D 29/522; F04D 29/526; F04D 29/547
See application file for complete search history.

(56) References Cited

U.S. PATENT DOCUMENTS 3,934,410 A * 1/1976 Williams ..... F04D 29/547 415/914
4,152,094 A 5/1979 Honda
4,238,170 A 12/1980 Robideau
4,313,417 A 2/1982 Briggs
4,630,993 A * 12/1986 Jensen ..... F04D 29/547 415/58.7
4,685,513 A 8/1987 Longhouse
4,836,148 A 6/1989 Savage
5,215,438 A 6/1993 Chou
5,489,186 A 2/1996 Yapp
6,124,567 A 9/2000 Feldhausen
6,558,120 B2 5/2003 Kim
6,595,744 B2 7/2003 Van Houten
7,029,229 B2 4/2006 Iwase
7,086,825 B2 8/2006 Wang
7,214,033 B2 5/2007 Lee
(Continued)

OTHER PUBLICATIONS

What Is An Axial Fan, Fans & Blowers, Jul. 25, 2023 (Year: 2023).*

*Primary Examiner* — Audrey B. Walter
(74) *Attorney, Agent, or Firm* — Armstrong Teasdale LLP

(57) ABSTRACT

An axial fan assembly for use with an HVAC system, including an axial fan and a housing. The axial fan includes a hub and one or more blades extending a blade length out to a blade tip. The hub is configured to rotate the blade tip of each of the one or more blades along a rotational travel path. The housing includes an inner surface radially outwards of the rotational travel path of the blade tip of the one or more blades, the inner surface having an inner diameter, and a housing portion proximate the rotational travel path of the blade tip of the one or more blades, the inner surface within the housing portion having an extended inner diameter to accommodate the blade length of the one or more blades and reduce a flow of air bypassing the one or more blades.

18 Claims, 3 Drawing Sheets

(56) References Cited

U.S. PATENT DOCUMENTS

| | | | | |
|---|---|---|---|---|
| 7,249,931 | B2 | 7/2007 | Parker | |
| 7,326,032 | B2 | 2/2008 | Vinson | |
| 8,568,095 | B2 | 10/2013 | Bushnell | |
| 8,834,121 | B2 | 9/2014 | Ikeda | |
| 9,267,510 | B2 | 2/2016 | Tadokoro | |
| 9,765,788 | B2 | 9/2017 | Dybenko | |
| 11,142,038 | B2 | 10/2021 | Stauter | |
| 11,346,229 | B2 | 5/2022 | Phelps | |
| 2003/0235495 | A1* | 12/2003 | Rivers | F04D 29/526 415/173.1 |
| 2004/0081553 | A1 | 4/2004 | Milana | |
| 2006/0182628 | A1 | 8/2006 | Kim | |
| 2006/0286924 | A1 | 12/2006 | Milana | |
| 2007/0098547 | A1* | 5/2007 | Vinson | H05K 7/20172 415/173.1 |
| 2010/0068028 | A1* | 3/2010 | Bushnell | F04D 29/164 415/200 |
| 2019/0234419 | A1 | 8/2019 | Dygert | |
| 2022/0297209 | A1 | 9/2022 | Wu | |

* cited by examiner

AXIAL FAN AND HOUSING ASSEMBLY AND METHODS OF USE THEREOF

FIELD

The embodiments described herein relate generally to axial fans, and more particularly, to an axial fan and housing assembly for use with an HVAC (heating ventilation and air conditioning) system.

BACKGROUND

At least some known HVAC systems may use an axial fan. However, using an axial fan with an HVAC system in an indoor and/or residential setting may be less effective, based on a reduced flow rate as achieved by the axial fan at a reasonable pressure. Additionally, an axial fan used with an indoor residential HVAC system may produce an undesired level of noise.

At least some known axial fan blades are fabricated using an injection molding process, which may result in a wide tolerance between a tip of the axial fan blades and an inner diameter of the housing enclosing the axial fan. This wide clearance may contribute to the reduced flow rate achieved by the axial fan. Additionally, the wide clearance may contribute to an undesired amount of power consumption by the HVAC system, due to the increase in clearance for air by-pass around the axial fan blade tips.

Therefore, there is a need for an axial fan and housing assembly for use with an HVAC system that includes a reduced clearance between the axial fan blade tips and the inner diameter of the housing enclosing the axial fan to facilitate reducing the clearance enabling air to by-pass around the axial fan blade tips to thereby improve the performance of the HVAC system.

BRIEF DESCRIPTION

In one aspect, an axial fan assembly for use with an HVAC system is disclosed. The axial fan assembly includes an axial fan and a housing. The axial fan includes a hub and one or more blades extending radially from a center point of the hub about which the axial fan rotates. Each of the one or more blades extends a blade length out to a blade tip, wherein the hub is configured to rotate the blade tip of each of the one or more blades along a rotational travel path. The housing includes an inner surface radially outwards of the rotational travel path of the blade tip of the one or more blades, wherein the inner surface is an inner diameter from the center point of the hub of the axial fan. The housing also includes a housing portion proximate the rotational travel path of the blade tip of the one or more blades within which the inner surface is an extended inner diameter from the center point of the hub of the axial fan to accommodate the blade length of the one or more blades and reduce a flow of air bypassing the one or more blades, the extended inner diameter being greater than the inner diameter.

In another aspect, a method of using an axial fan assembly with an HVAC system is disclosed. The method includes providing an axial fan comprising a hub and one or more blades extending radially from a center point of the hub about which the axial fan rotates, each of the one or more blades extending a blade length out to a blade tip, wherein the hub is configured to rotate the blade tip of each of the one or more blades along a rotational travel path. The method also includes enclosing the axial fan within a housing comprising an inner surface radially outwards of the rotational travel path of the blade tip of the one or more blades, wherein the inner surface is an inner diameter from the center point of the hub of the axial fan. The housing comprises a housing portion proximate the rotational travel path of the blade tip of the one or more blades within which the inner surface is an extended inner diameter from the center point of the hub of the axial fan. The extended inner diameter is greater than the inner diameter. The method further includes rotating the axial fan within the housing, wherein the blade length of the one or more blades is accommodated by the extended inner diameter within the housing portion to facilitate reducing a flow of air bypassing the one or more blades.

DETAILED DESCRIPTION

An axial fan and housing assembly for use with an HVAC (heating ventilation and air conditioning) system is provided according to various embodiments of the present disclosure.

Figure 1:
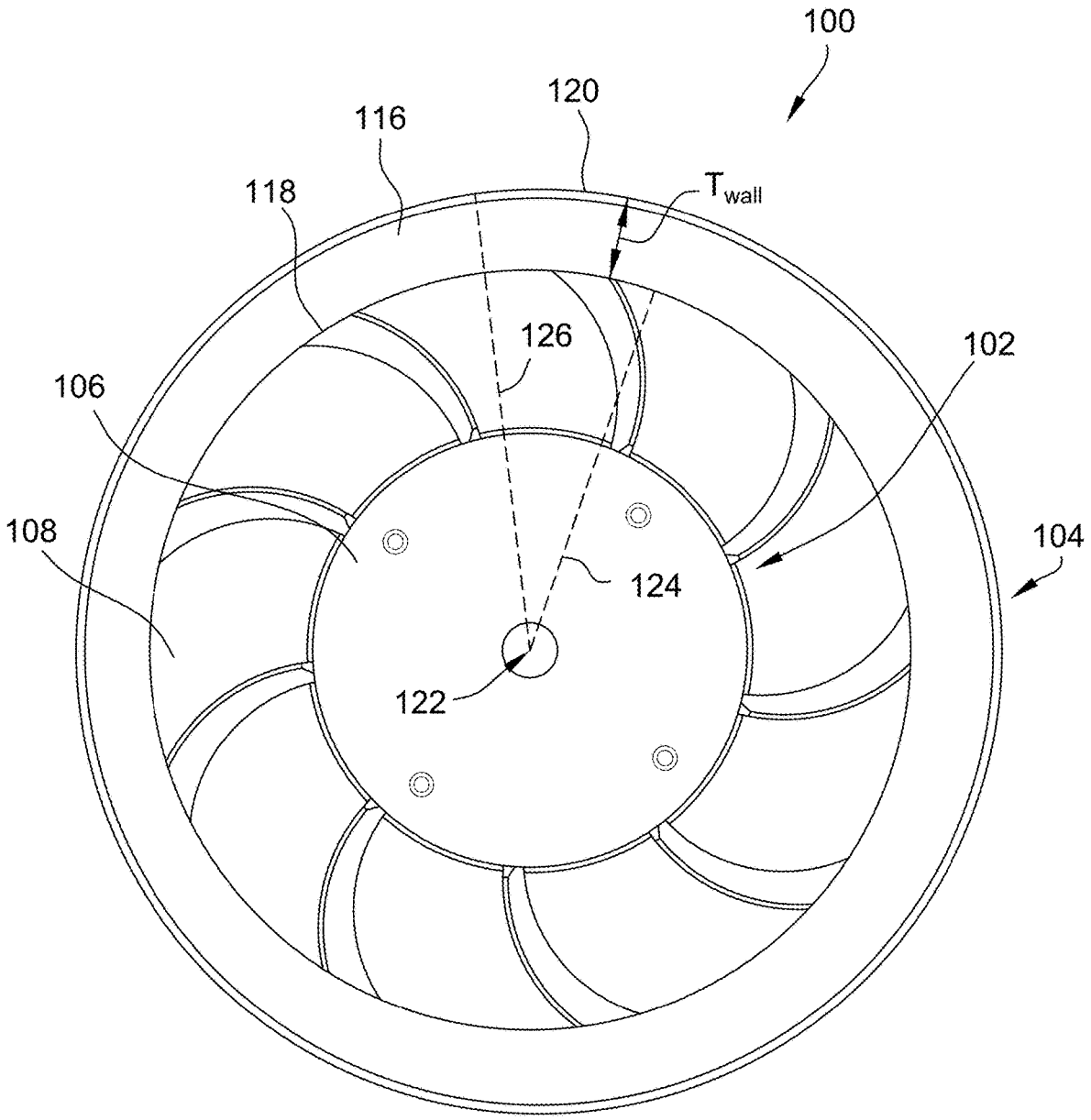
FIG. 1 illustrates a front view of an axial fan assembly in accordance with one or more embodiments of the present disclosure.

FIG. 1 illustrates a front view of an axial fan assembly 100 in accordance with one or more embodiments of the present disclosure. The axial fan assembly 100 includes an axial fan 102 and a housing 104 that encloses the axial fan 102. The axial fan 102 includes a hub 106 and one or more blades 108 extending radially from the hub 106. The hub 106 includes a first end 110, a second end 112, and an axis of rotation 114 oriented from the first end 110 to the second end 112 (shown in FIG. 2). The hub 106 may be assembled to one or more HVAC system components by welding, fastening, and/or interference fits between components.

The housing 104 includes a wall 116. In one embodiment, the wall 116 has an endless circular shape. In other embodiments, the wall 116 may be any suitable shape that enables the axial fan assembly 100 to function as described herein. The wall 116 includes an inner surface 118 and an outer surface 120, with a thickness $T_{wall}$ as measured between the inner surface 118 and the outer surface 120 (shown in FIG. 1). In the exemplary embodiment, a center 122 of the hub 106 is aligned with the axis of rotation 114. An inner diameter 124 is defined between the center 122 and the inner surface 118, and an outer diameter 126 is defined between the center 122 and the outer surface 120. The difference between the inner diameter 124 and the outer diameter 126 is the thickness $T_{wall}$ measured between the inner surface 118 and the outer surface 120 (shown in FIG. 1).

Figure 2:
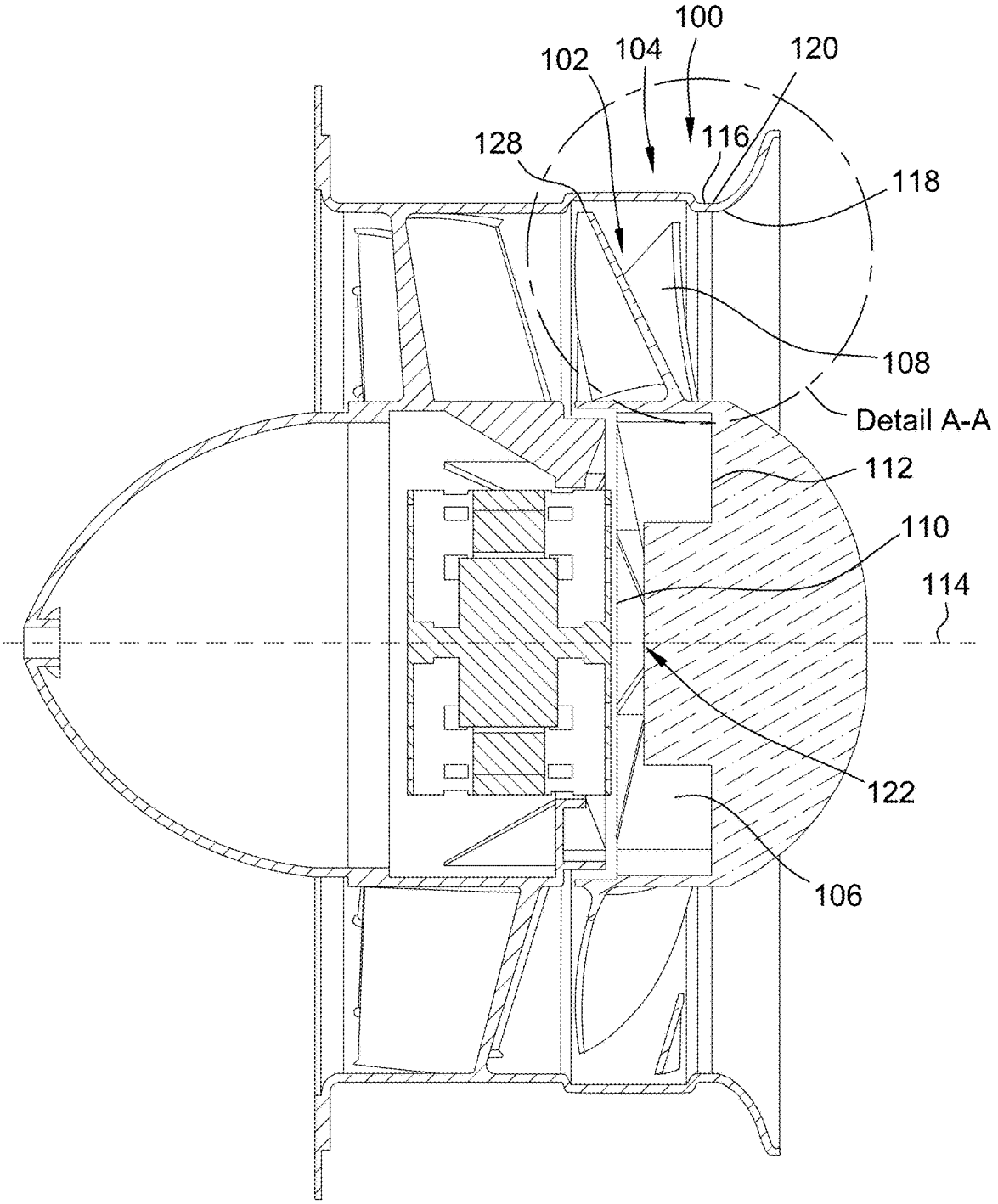
FIG. 2 illustrates a longitudinal cross-sectional view of the axial fan assembly taken along line 2-2 shown in FIG. 1.
Figure 3:
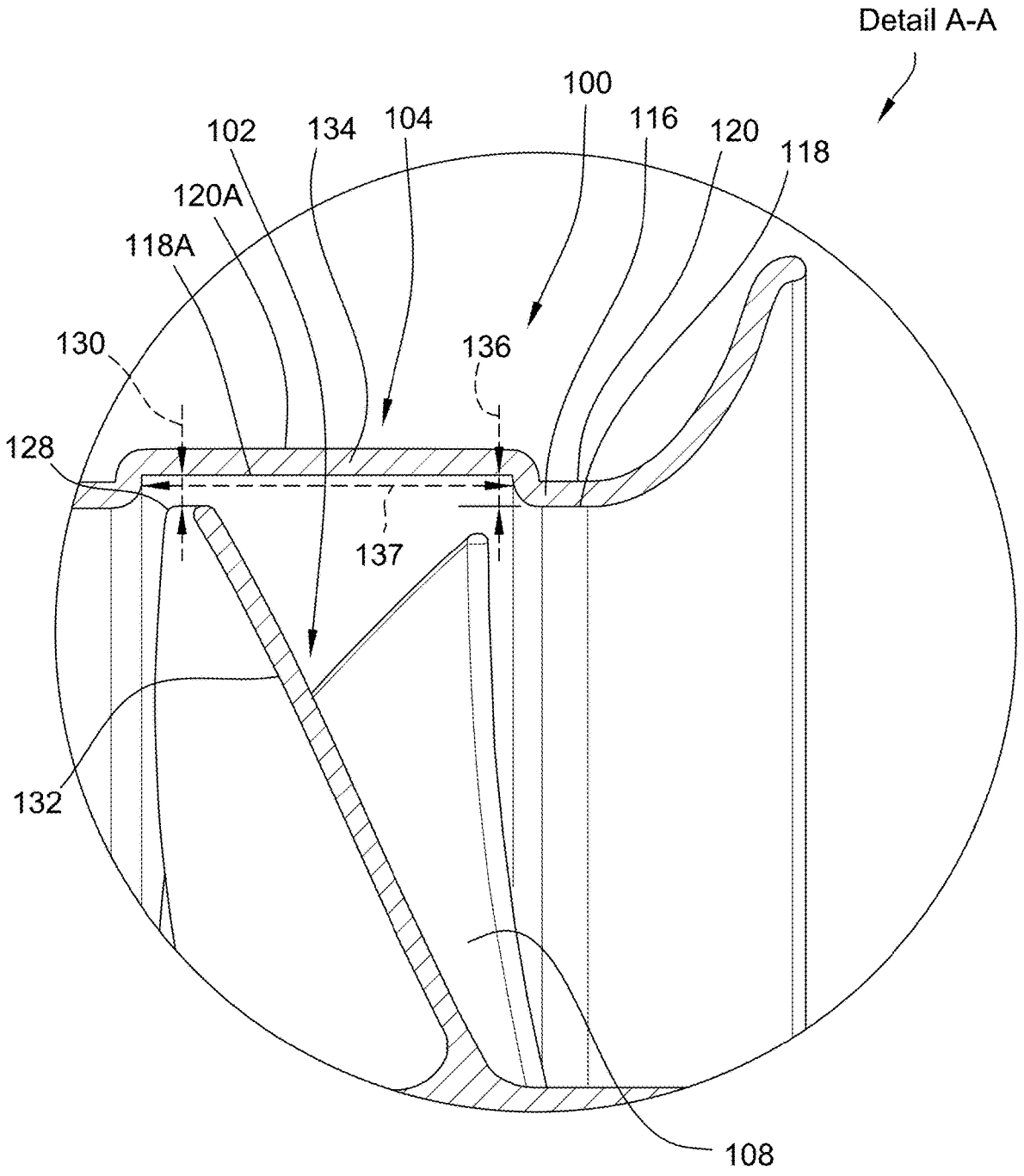
FIG. 3 illustrates an enlarged view of Detail A-A of the axial fan assembly shown in FIG. 2.

FIG. 2 illustrates a longitudinal cross-sectional view of the axial fan assembly 100 shown in FIG. 1. FIG. 3 illustrates an enlarged view of Detail A-A of the axial fan assembly 100 shown in FIG. 2. Each blade 108 of the axial fan 102 includes a blade tip 128 that defines an outermost end of the blade 108 as measured from the hub 106. The housing 104 may include a gap 130 between the blade tip 128 of the one or more blades 108 and the inner surface 118 of the housing 104 (shown in FIG. 3). For example, fabricating the blades 108 of the axial fan 102 using an injection molding process may result in a wide tolerance of an outermost measurement of the blade tips 128 (e.g., a length 132 of the blade 108) with respect to the inner diameter 124 of the inner surface 118 of the housing 104.

During operation of the axial fan 102, air may by-pass the blades 108 by flowing through the gap 130 between the blade tip 128 of the one or more blades 108 and the inner surface 118 of the housing 104. This may result in an increase in power consumption by the HVAC system to operate the axial fan 102, in addition to a decrease in flow rate achieved by the operation of the axial fan 102. To facilitate improved efficiency and/or production of the axial fan 102, the length 132 of the blade 108 may be increased to reduce the gap 130. The length 132 is defined as the distance between the blade tip 128 and the blade root. Increasing the length 132 of the blade 108 to interfere with the inner surface 118 of the housing 104, such as by increasing the length 132 of the one or more blades 108 to be equal to or greater than the inner diameter 124 of the inner surface 118 of the housing 104, would negatively impact the operation of the axial fan 102. Thus, it may be advantageous to increase the inner diameter 124 of the inner surface 118 of the housing 104 proximate the path of the blade tips 128 of the axial fan 102 to accommodate an increase in the length 132 of the one or more blades 108.

As shown in FIG. 3, the wall 116 of the housing 104 may include a portion 134 within which the inner diameter 124 of the inner surface 118 is increased. That is, the inner diameter 124 between the center 122 of the hub 106 (shown in FIGS. 1 and 2) and the inner surface 118 of the housing 104 may be larger within the portion 134, and immediately proximate the blades 108. For example, the inner diameter 124 may be increased to define an extended inner surface 118A. The portion 134 has a radial dimension 136 that is defined as the distance between the inner surface 118 and the extended inner surface 118A. A longitudinal dimension 137 of the portion 134 is defined between longitudinally outermost blade rotation paths (shown in FIG. 3), and the radial dimension 136 extends along the longitudinal dimension 137 of portion 134.

The increase of the inner diameter 124 by the radial dimension 136 may facilitate improved efficiency and/or production of the axial fan 102. For example, within the portion 134 of the wall 116, the length 132 of the blade 108 may be increased to reduce the size of the gap 130 between the blade tip 128 and the inner surface 118. Additionally, for example, the flow of air by-passing the one or more blades 108 may be interrupted by the change in direction required for air to flow up and over the blade tip 128 as the inner surface 118 transitions between the inner surface 118 and the extended inner surface 118A. Thus, as a result of the increase in the length 132 of the blade 108 and/or the more torturous path for air by-pass around the blades 108, the flow rate achieved by the operation of the axial fan 102 may be increased while decreasing the power consumed by the HVAC system to operate the axial fan 102.

A technical effect of the system described herein includes at least one of: (a) increased flow rate achieved by operation of an axial fan; (b) decreased power consumption by an HVAC system to operate the axial fan; and (c) use of the axial fan fabricated by injection molding in an indoor and/or residential HVAC system.

In the foregoing specification and the claims that follow, a number of terms are referenced that have the following meanings.

As used herein, an element or step recited in the singular and preceded with the word "a" or "an" should be understood as not excluding plural elements or steps, unless such exclusion is explicitly recited. Furthermore, references to "example implementation" or "one implementation" of the present disclosure are not intended to be interpreted as excluding the existence of additional implementations that also incorporate the recited features.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. Here, and throughout the specification and claims, range limitations may be combined or interchanged. Such ranges are identified and include all the sub-ranges contained therein unless context or language indicates otherwise.

Disjunctive language such as the phrase "at least one of X, Y, or Z," unless specifically stated otherwise, is generally understood within the context as used to state that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present. Additionally, conjunctive language such as the phrase "at least one of X, Y, and Z," unless specifically stated otherwise, should also be understood to mean X, Y, Z, or any combination thereof, including "X, Y, and/or Z."

The systems and methods described herein are not limited to the specific embodiments described herein, but rather, components of the systems and/or steps of the methods may be utilized independently and separately from other components and/or steps described herein.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any layers or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An axial fan assembly for use with an HVAC system, the axial fan assembly comprising:

an axial fan comprising a hub and one or more blades extending radially from a center point of the hub about which the axial fan rotates, each of the one or more blades extending a blade length out to a blade tip, wherein the hub is configured to rotate the blade tip of each of the one or more blades along a rotational travel path; and a housing comprising an inner surface and an outer surface, the inner and outer surfaces radially outwards of the rotational travel path of the blade tip of the one or more blades, wherein the inner surface is an inner diameter from the center point of the hub of the axial fan and the outer surface is an outer diameter from the center point of the hub of the axial fan, wherein the housing comprises a housing portion proximate the rotational travel path of the blade tip of the one or more blades within which the inner surface is an extended inner diameter from the center point of the hub of the axial fan and the outer surface is an extended outer diameter from the center point of the hub of the axial fan to accommodate the blade length of the one or more blades and reduce a flow of air bypassing the one or more blades, the extended inner diameter being greater than the inner diameter and the extended outer diameter being greater than the outer diameter, wherein the housing inner surface transitions from the inner surface having the inner diameter to the extended inner surface having the extended inner diameter back to the inner surface having the inner diameter.

2. The axial fan assembly of claim 1, wherein the one or more blades are fabricated by injection molding.

3. The axial fan assembly of claim 1, wherein the HVAC system is an indoor HVAC system.

4. The axial fan assembly of claim 1, wherein the HVAC system is a residential HVAC system.

5. The axial fan assembly of claim 1, wherein the blade length of the one or more blades is greater than the inner diameter.

6. The axial fan assembly of claim 5, wherein the blade length of the one or more blades is less than the extended inner diameter.

7. The axial fan assembly of claim 1, wherein the housing further comprises a gap between the inner surface of the housing and the blade tip of the one or more blades of the axial fan.

8. The axial fan assembly of claim 7, wherein the flow of air bypasses the one or more blades by flowing through the gap between the inner surface of the housing and the blade tip of the one or more blades of the axial fan.

9. The axial fan assembly of claim 8, wherein the flow of air bypassing the one or more blades includes a directional air flow change for at least one of entering and exiting the housing portion.

10. A method of using an axial fan assembly with an HVAC system, the method comprising:

providing an axial fan comprising a hub and one or more blades extending radially from a center point of the hub about which the axial fan rotates, each of the one or more blades extending a blade length out to a blade tip, wherein the hub is configured to rotate the blade tip of each of the one or more blades along a rotational travel path;

enclosing the axial fan within a housing comprising an inner surface and an outer surface, the inner and outer surfaces radially outwards of the rotational travel path of the blade tip of the one or more blades, wherein the inner surface is an inner diameter from the center point of the hub of the axial fan and the outer surface is an outer diameter from the center point of the hub of the axial fan, and wherein the housing comprises a housing portion proximate the rotational travel path of the blade tip of the one or more blades within which the inner surface is an extended inner diameter from the center point of the hub of the axial fan and the outer surface is an extended outer diameter from the center point of the hub of the axial fan, the extended inner diameter being greater than the inner diameter and the extended outer diameter being greater than the outer diameter wherein the housing inner surface transitions from the inner surface having the inner diameter to the extended inner surface having the extended inner diameter back to the inner surface having the inner diameter; and rotating the axial fan within the housing, wherein the blade length of the one or more blades is accommodated by the extended inner diameter within the housing portion to facilitate reducing a flow of air bypassing the one or more blades.

11. The method of claim 10, further comprising reducing a power consumption amount consumed by the HVAC system to use the axial fan compared to an axial fan assembly without an extended inner diameter of the inner surface and with the blades having a shorter blade length.

12. The method of claim 10, further comprising increasing a production flow rate of the axial fan compared to an axial fan assembly without an extended inner diameter of the inner surface and with the blades having a shorter blade length.

13. The method of claim 10, wherein the HVAC system is at least one of an indoor HVAC system and a residential HVAC system.

14. The method of claim 10, wherein enclosing the axial fan within the housing comprises maintaining a gap between the inner surface of the housing and the blade tip of the one or more blades of the axial fan.

15. The method of claim 14, wherein rotating the axial fan comprises the flow of air bypassing the one or more blades by flowing through the gap between the inner surface of the housing and the blade tip of the one or more blades of the axial fan.

16. The method of claim 15, wherein the flow of air bypassing the one or more blades comprises at least one directional air flow change.

17. The method of claim 15, wherein the flow of air bypassing the one or more blades comprises a directional air flow change as the flow of air enters the housing portion.

18. The method of claim 15, wherein the flow of air bypassing the one or more blades comprises a directional air flow change as the flow of air exits the housing portion.

* * * * *